US011744754B2

(12) United States Patent
Lai et al.

(10) Patent No.: US 11,744,754 B2
(45) Date of Patent: Sep. 5, 2023

(54) NURSING BED FOR DEFECATION AND SELF-CLEANING

(71) Applicants: Cheng-Piao Lai, Taoyuan (TW); Ting-Yu Lai, Taoyuan (TW)

(72) Inventors: Cheng-Piao Lai, Taoyuan (TW); Ting-Yu Lai, Taoyuan (TW)

( * ) Notice: Subject to any disclaimer, the term of this patent is extended or adjusted under 35 U.S.C. 154(b) by 123 days.

(21) Appl. No.: 17/354,055

(22) Filed: Jun. 22, 2021

(65) Prior Publication Data

US 2022/0401279 A1 Dec. 22, 2022

(51) Int. Cl.
*A61G 7/02* (2006.01)
*A47K 11/02* (2006.01)

(52) U.S. Cl.
CPC ..... *A61G 7/02* (2013.01); *A47K 11/02* (2013.01)

(58) Field of Classification Search
CPC ..... A61G 7/02
See application file for complete search history.

(56) References Cited

U.S. PATENT DOCUMENTS

2003/0088918 A1* 5/2003 Tanaka ..... A61G 9/003 5/605
2017/0216116 A1* 8/2017 Lai ..... A61G 7/015
2017/0333272 A1* 11/2017 Foster ..... A61G 7/02

FOREIGN PATENT DOCUMENTS

WO WO-2019157610 A1 * 8/2019 ..... A47K 7/08

* cited by examiner

*Primary Examiner* — Robert G Santos
*Assistant Examiner* — Adam C Ortiz
(74) *Attorney, Agent, or Firm* — Rosenberg, Kiein & Lee

(57) ABSTRACT

A nursing bed for defecation and self-cleaning comprises a bed frame, a bed board device, a moveable cushion, a support frame, a bedpan, an excreta container; The bedpan is hung under the movable cushion through a support frame. When the patient wants to defecate, the patient only needs to remove a cushion and make the bedpan mouth of the bedpan facing the defecation hole of the moveable cushion, then the patient can defecate on the nursing bed; and further having a cleaning device a warm water supply device, using an electric heater to heat the cleaning water to an appropriate temperature to clean the patient's buttocks, thereby reducing the infection of germs, and also cleaning the excrement that attached to the bedpan to keeps the bedpan clean.

6 Claims, 13 Drawing Sheets

NURSING BED FOR DEFECATION AND SELF-CLEANING

BACKGROUND OF THE INVENTION

1. Field of the Invention

The invention relates to a nursing bed for defecation and self-cleaning, especially to one that allow the patient to clean their butt on the bed with warm water after defecation, and it is convenient for excrement removal and washing.

2. Description of the Related Art

Bedpan is one of the most commonly used assistive devices in hospital beds or home care. It is suitable for patients who have to excrete on the bed due to weakness, injury or surgery. However, when using the bedpan, the patient's limbs must be raised and placed under the buttocks. After the defecation is completed, it must be removed from underneath the limbs and cleaned. Therefore, the traditional bedpan is very inconvenient to use; Especially for patients who excrete in frequent situations, the bedpan needs to be repeatedly inserted and removed, therefore, for the nursing staff, the burden is overwhelming.

In order to solve the inconvenience problem of using traditional bedpan, I used to develop a bedpan fixed under the hospital bed, in which the through hole of the bedpan is provided with a hole cover, the hole cover covers the through hole by the forward movement or moved backward to expose the through hole. In this way, the problem in the prior art that the patient's limbs need to be moved to be able to defecate on the hospital bed can be solved.

Although the above-mentioned innovation can improve the inconvenience of moving the patient's limbs, however, the excrement is left in the bedpan. Because the lid of the bedpan is not tightly sealed, the odor of excrement is easily dispersed in the air, causing the ward to be full of foul smells. Therefore, how to easily remove the bedpan to remove and clean the excrement has become a subject that I must actively think about and solve.

SUMMARY OF THE INVENTION

It is a primary objective of the present invention to provide a nursing bed for defecation and self-cleaning that allow the patient to defecate without moving the patient's limbs, and the excrement container can be easily separated from the bedpan to facilitate the removal and washing of excrement.

It is another objective of the present invention to provide a nursing bed for defecation and self-cleaning that has a cleaning device on the excrement collector, so that the patient can wash his butt with warm water immediately after defecation, so as to reduce the infection of germ.

With the feature disclosed above, has below effect:

(1) In the present invention, the lower edge of the bedpan is connected with an excreta container, and the bedpan is hung under the movable cushion through a support frame. When the patient wants to defecate, the patient only needs to remove the third cushion and make the bedpan mouth of the bedpan facing the defecation hole of the moveable cushion, then the patient can defecate on the nursing bed; after the defecation, actuate the hold paddles to pivot the support frame toward the ground, and wait for the support rod until reaching the ground, then move the seat of the bedpan to the outside of the support frame. Then the excreta container can be easily rotated to be separated from the bedpan to carry out excrement removal and cleaning operations.

(2) This present invention is further equipped with a cleaning device and a warm water supply device. The electric heater is used to heat the cleaning water to an appropriate temperature to clean the patient's buttocks, thereby reducing the infection of germs, and also cleaning the excrement that attached to the bedpan to keeps the bedpan clean.

DETAILED DESCRIPTION OF THE PREFERRED EMBODIMENT

Figure 1:
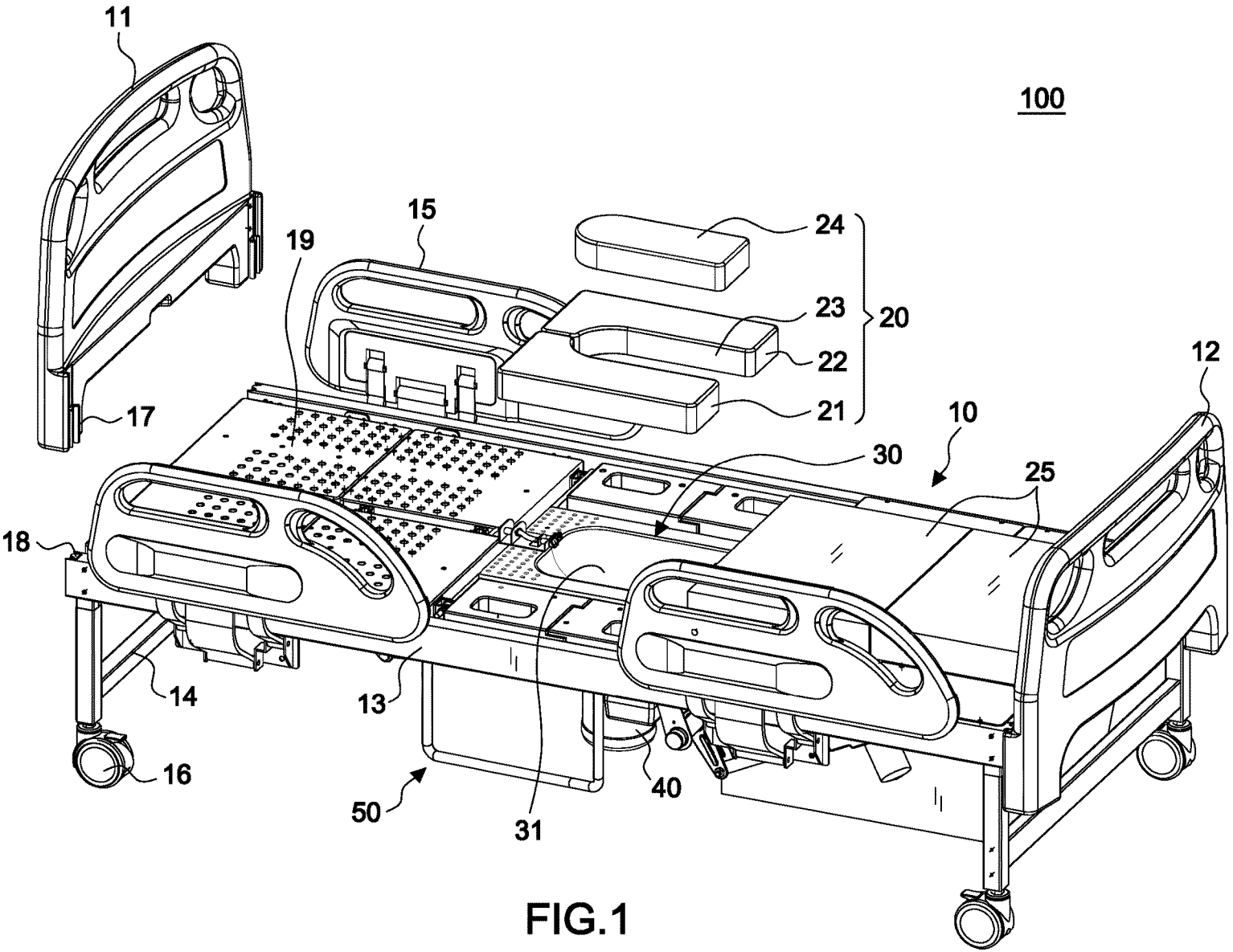
FIG. 1 is an exploded perspective view of a preferred embodiment of the present invention.
Figure 2:
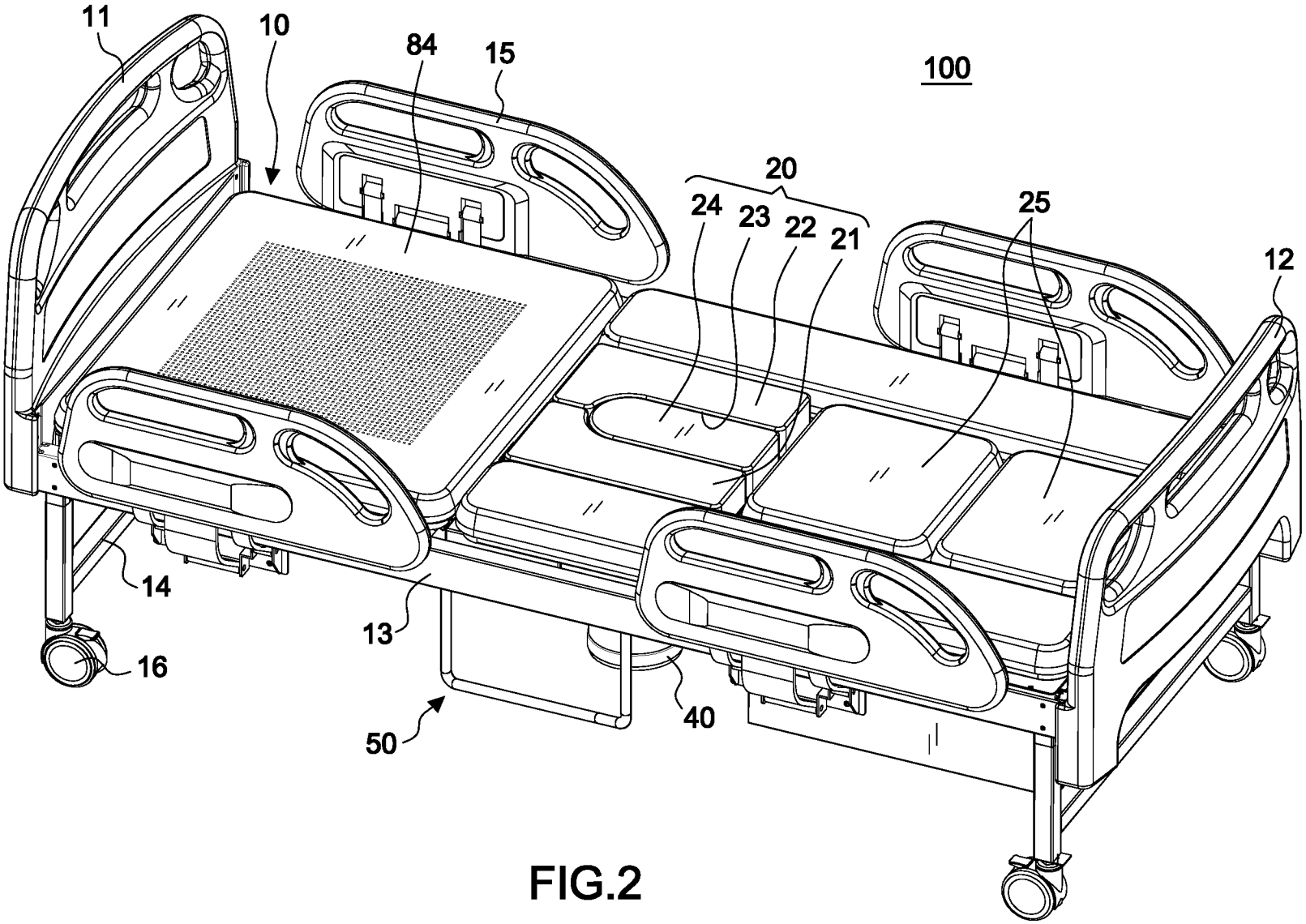
FIG. 2 is an assembly perspective view of a preferred embodiment of the present invention.
Figure 3:
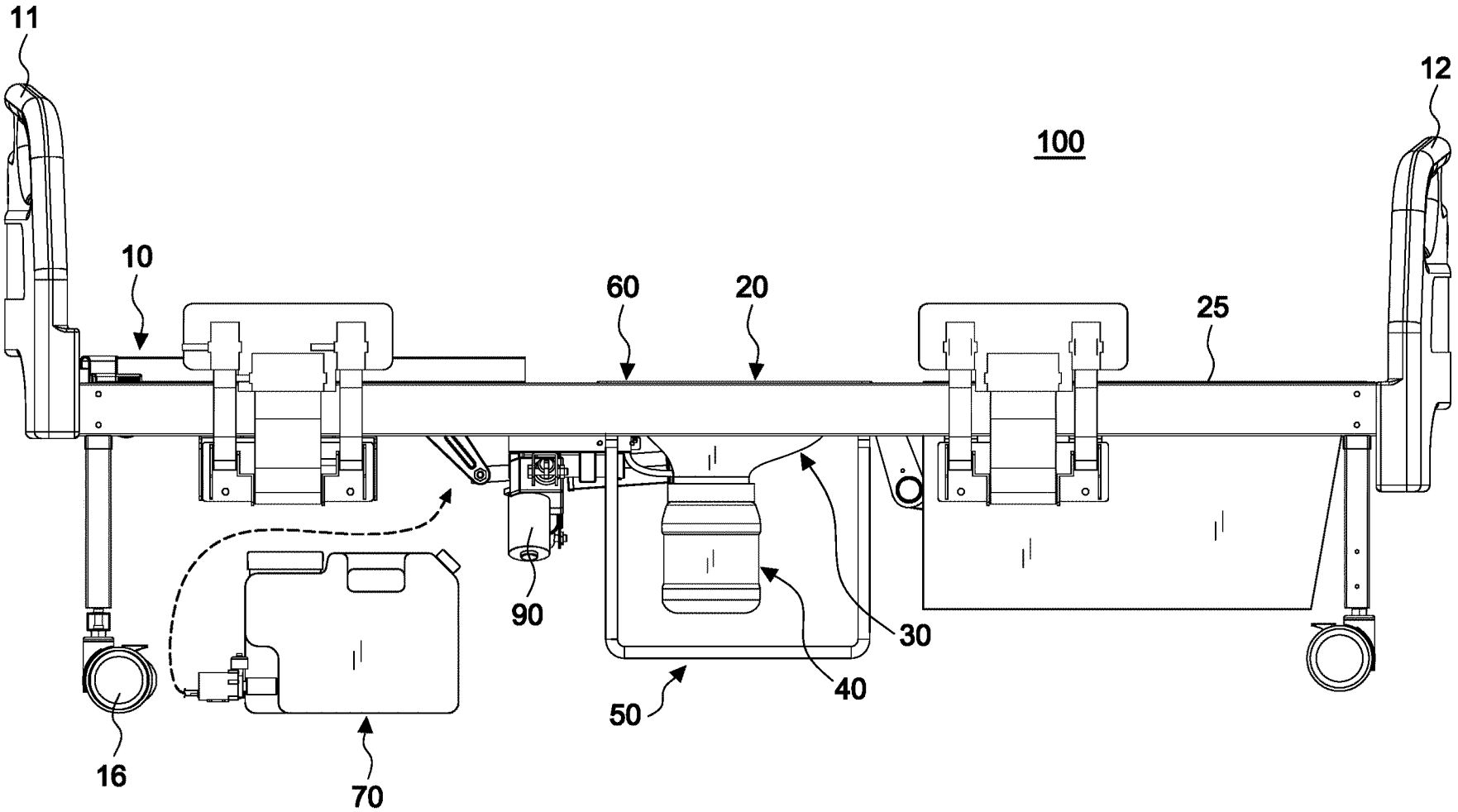
FIG. 3 is an assembly front view of a preferred embodiment of the present invention.

Referring to FIGS. 1-3, the nursing bed for defecation and self-cleaning 100 of the present invention, comprising: a bed frame 10, forming by a front frame 11, a rear frame 12, multiple longitudinal frames 13 and horizontal frames 14 linked between said front frame 11 and said rear frame 12, four set of bed rails 15, and four set of bed wheel 16; wherein said bed rails 15 are arranged on said longitudinal frames 13, they have the function of pivoting and positioning up and down, however, the pivoting and positioning mechanism is a conventional technology and is not a requirement of the present invention, so I will not mention the detail; Also, said front frame 11 and said rear frame 12 having at least a latch 17, and said longitudinal frame 13 has a latch slot 18 corresponding to said latch 17, so as to make said front frame 11 and said rear frame 12 be easy to disassemble and assemble with said longitudinal frames 13; A bed board device 19, arranged on said bed frame 10 and arranged between said front frame 11 and said rear frame 12.

A moveable cushion 20 which can be separated from said bed board device 19, arranged on said bed frame 10 and arranged between said front frame 11 and said rear frame 12; said moveable cushion 20 at least includes a first cushion 21 and a second cushion 22, between said first cushion 21 and said second cushion 22 have a defecation hole 23, and a third cushion 24 which can be easily removed is arranged on said defecation hole 23; In this embodiment, said first cushion 21 and said second cushion 22 can be symmetrically separated, or can be integrally formed. In addition, on said bed frame 10, a fourth cushion 25 can be arranged on the rear side.

A bedpan 30, having bedpan mouth 31 and a seat 32 arranged on the outer edge of said bedpan mouth 31. The lower edge of said seat 32 is connected to an excreta container 40, and said bedpan 30 is hung under said third cushion 24 by a support frame 50.

Figure 4:
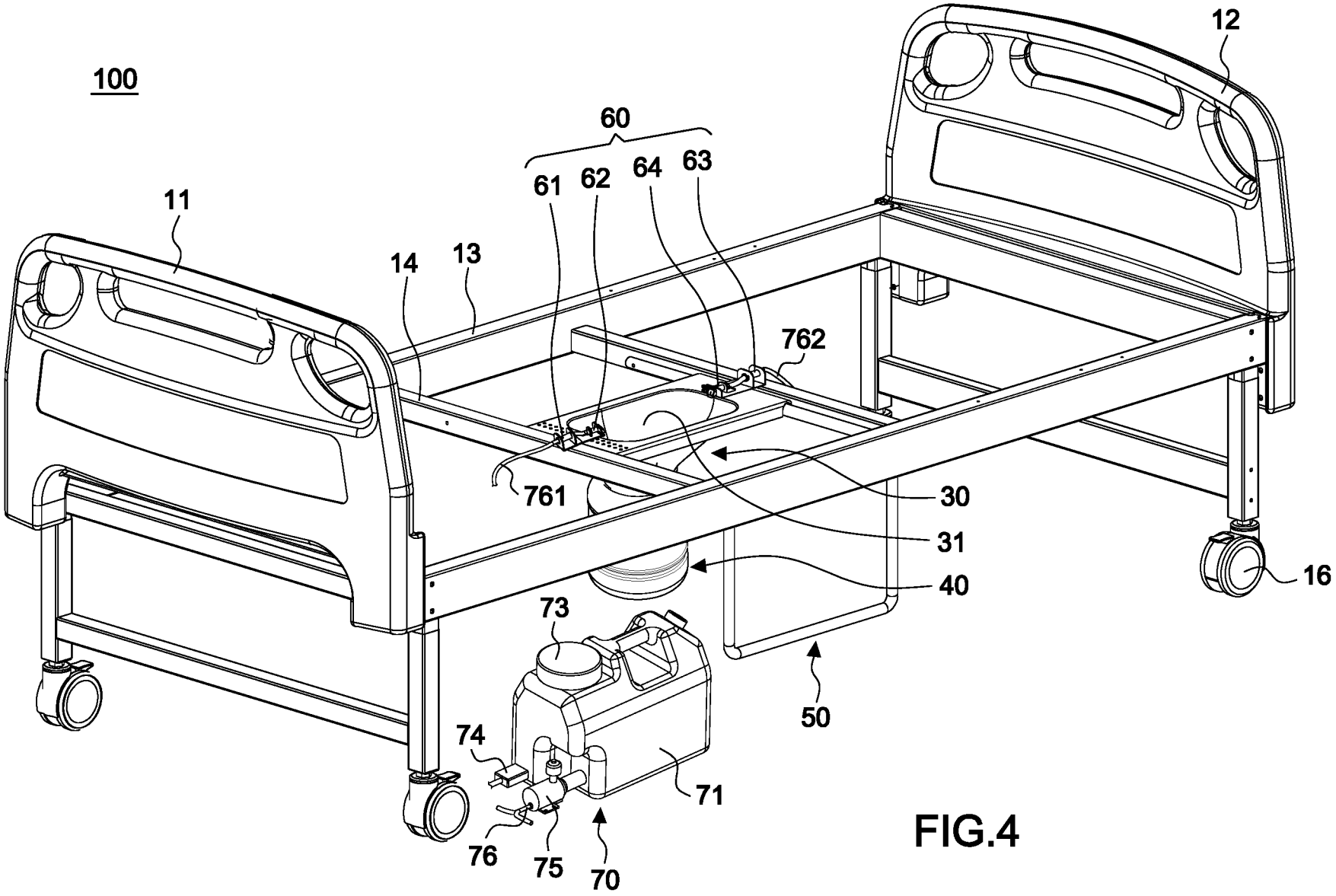
FIG. 4 is an assembly perspective view of the mechanism that is easy to disassemble of the present invention.
Figure 5A:
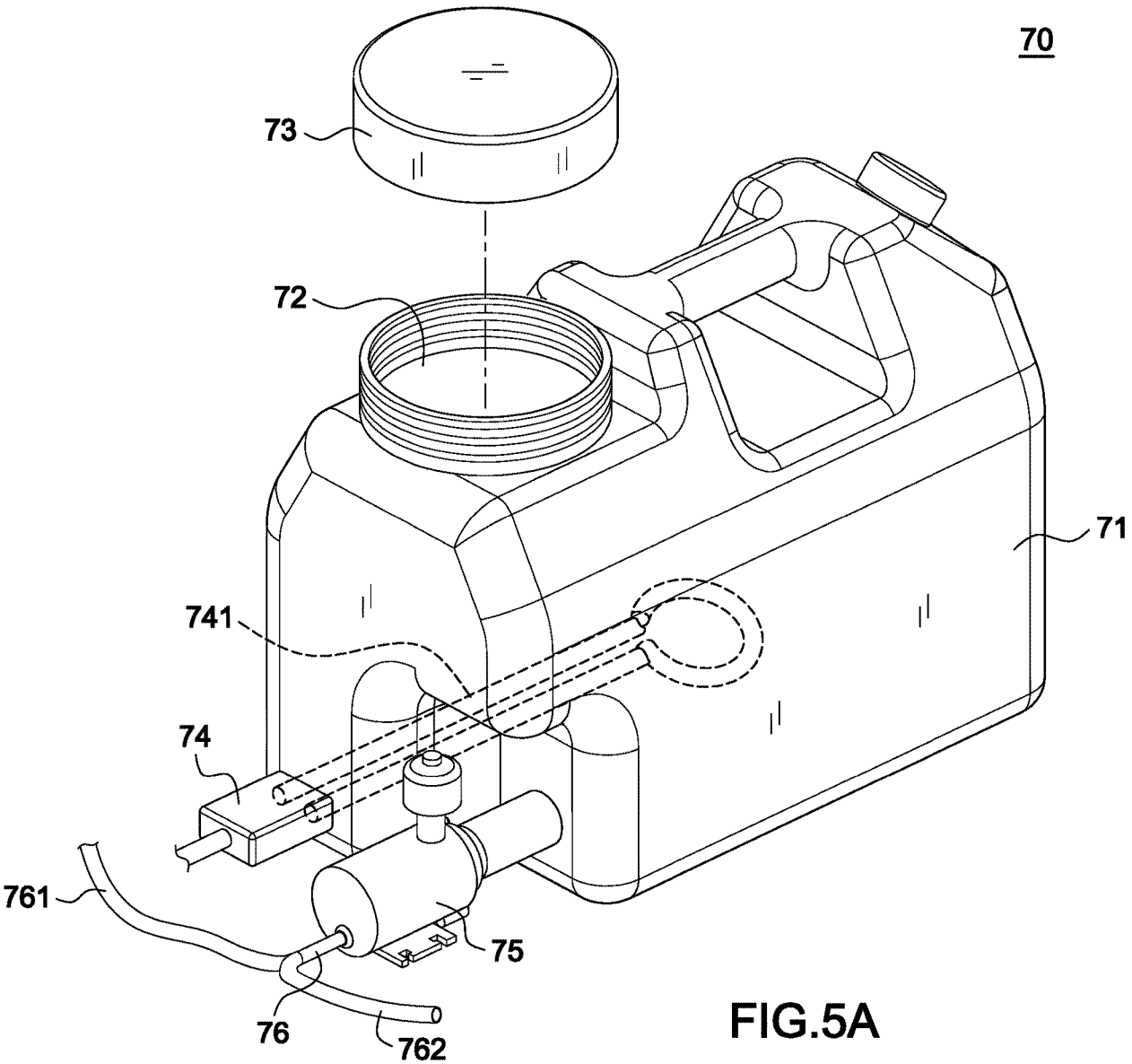
FIG. 5A is a perspective view of a warm water supply device of the present invention.
Figure 5B:
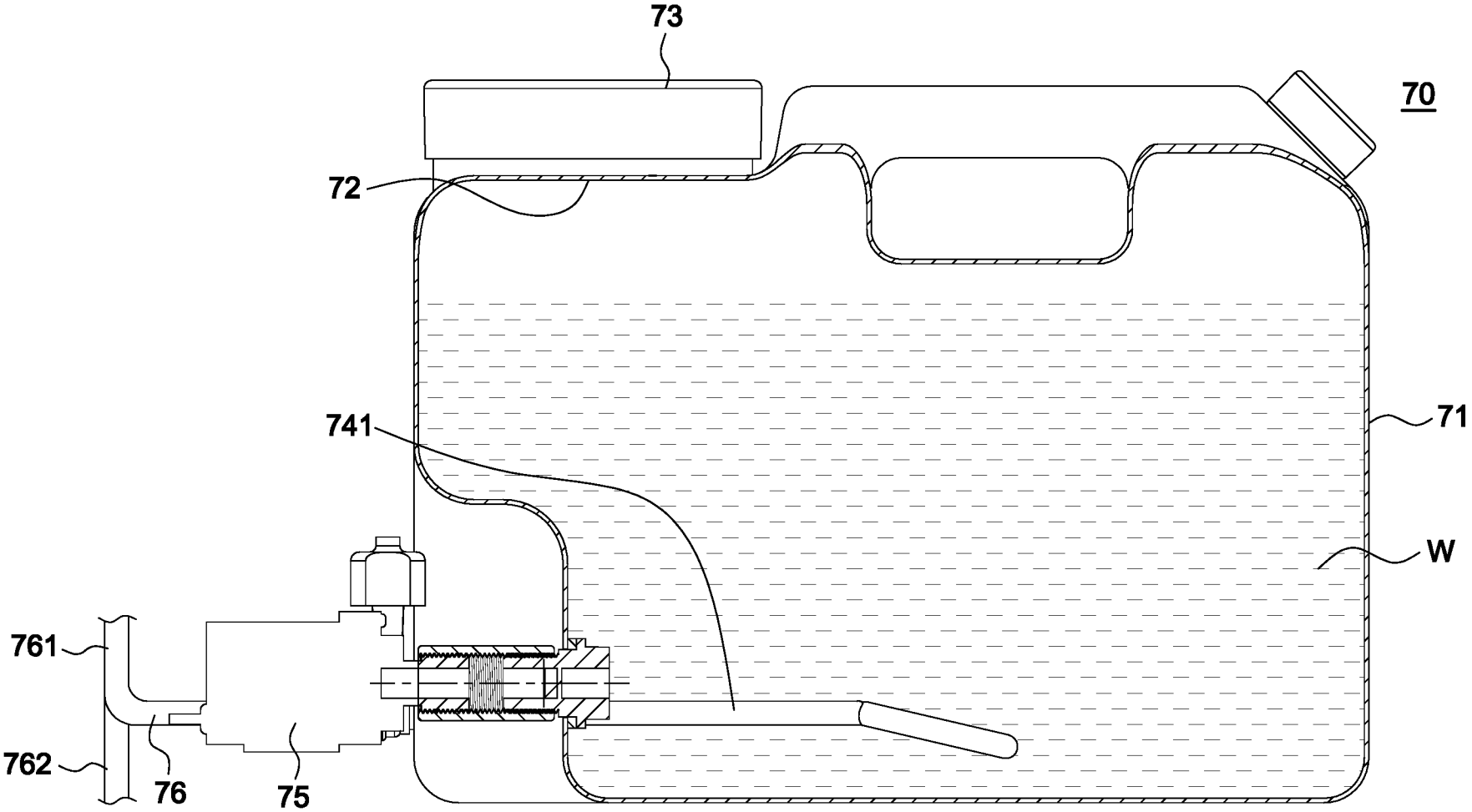
FIG. 5B is a sectional view of a warm water supply device of the present invention.
Figure 5C:
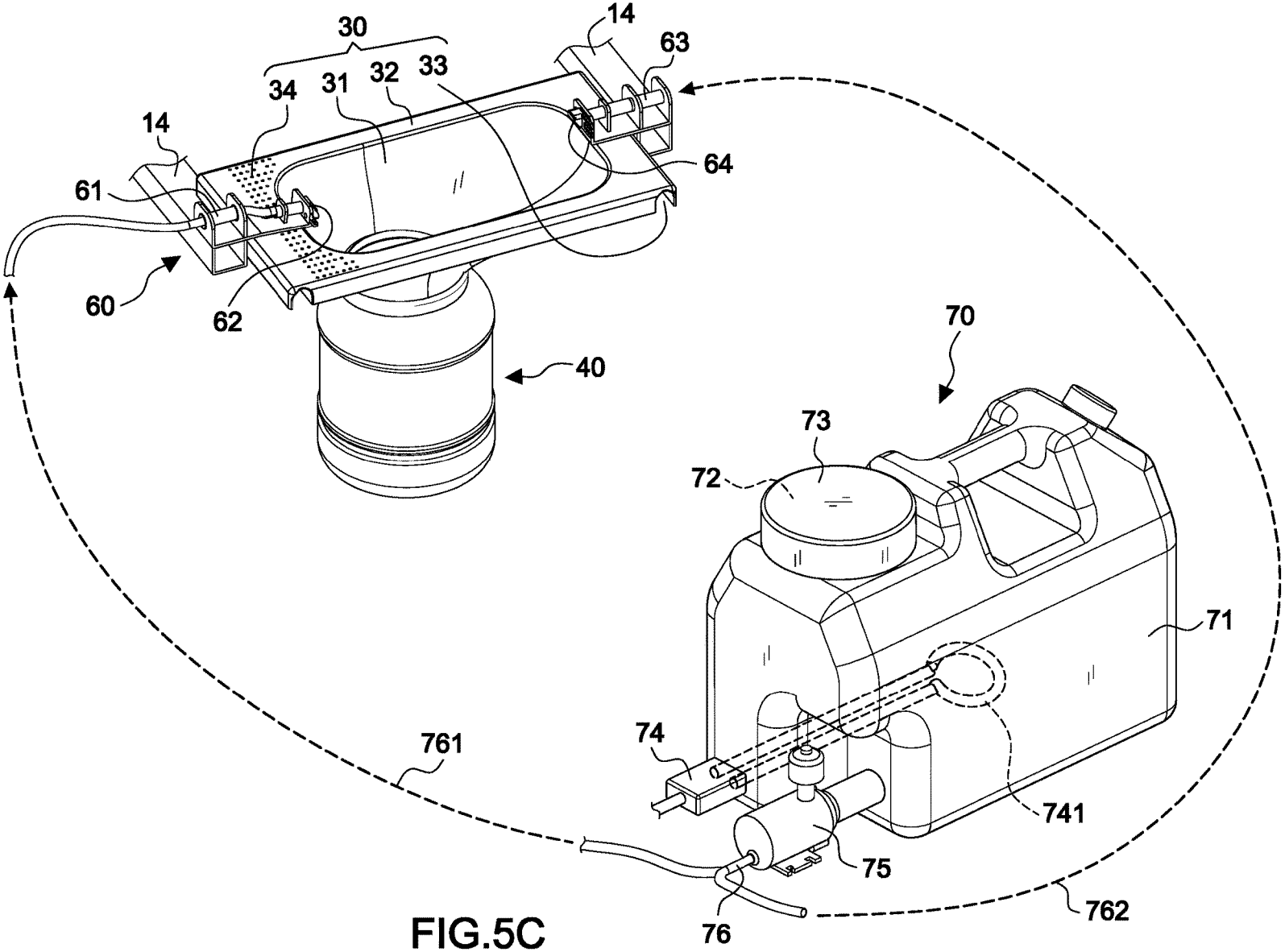
FIG. 5C is a perspective view of a warm water supply device and a cleaning device of the present invention.
Figure 6:
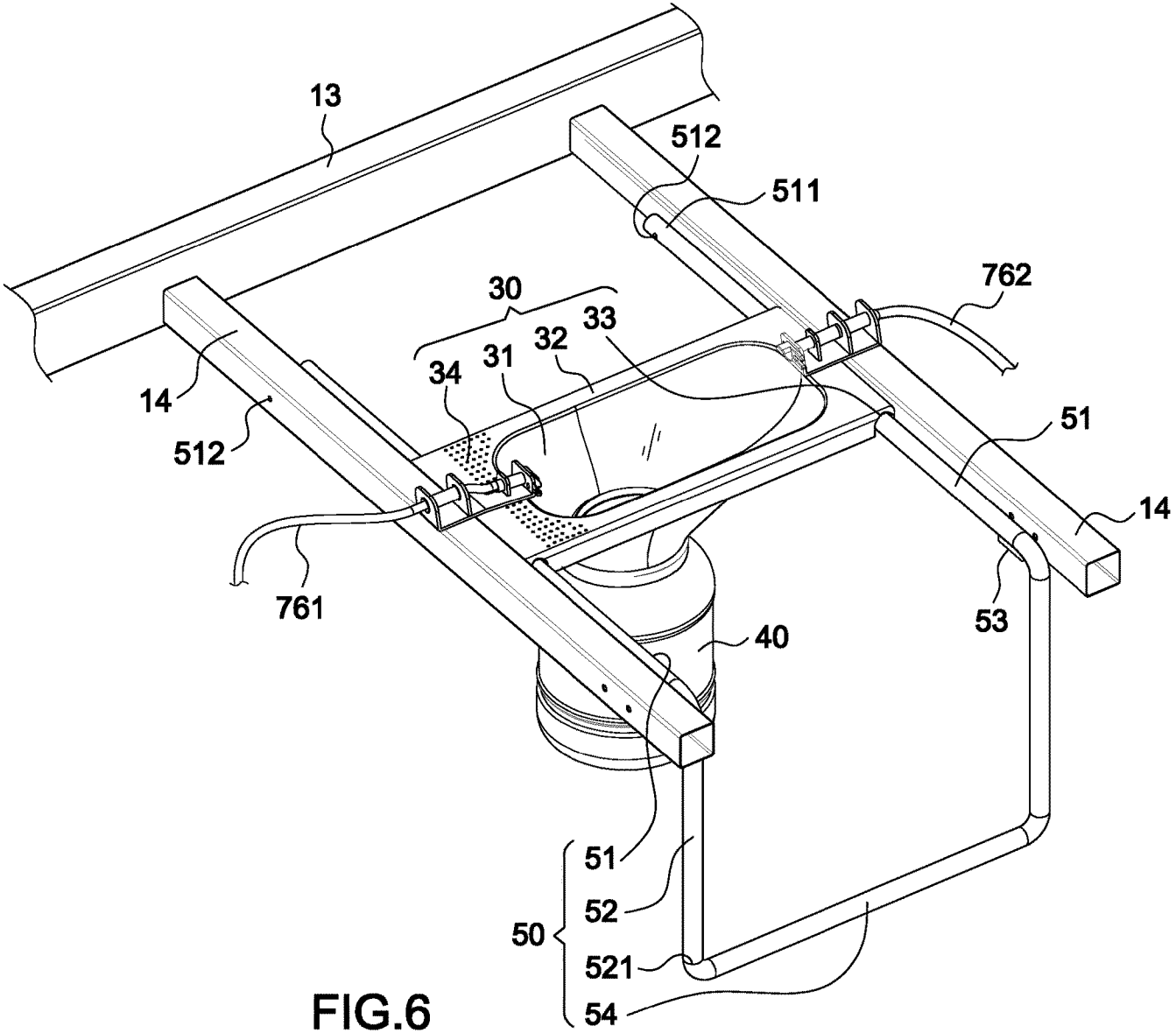
FIG. 6 is a perspective view of a support frame of the present invention.

Also, further referring to FIGS. 4-6, said support frame 50, having a pair of horizontal rods 51 and a pair of stand rods 52 symmetrically arranged and vertically connected, wherein free ends 511 of each said horizontal rods 51 are individually pivotally connected to the inner side of said horizontal frames 14 by a pivoting element 512, and at least a hold paddle 53 is pivoted on said horizontal frames 14 and hung on the lower edge of said horizontal rods 51 for letting said support frame 50 hang on said bed frame 10 and keeping the lower ends of said stand rods 52 away from the ground; In this embodiment, said support frame 50 further has a support rod 54 which connected to the bottom ends of said pair of stand rods 52 to increase the rigidity of said support frame 50.

Said bedpan 30, having a bedpan mouth 31 at the top and having a seat 32 with a groove 33 at the outer periphery of said bedpan mouth 31, and said bedpan 30 is hung at the outer periphery of said horizontal rods 51; said seat 32 is shrinking downward to form a shrinking part 35 at the lower end, and said shrinking part 35 is designed with thread; moreover, said excreta container 40 has a container mouth 42 at the top of said container body 41 and has a bottom surface 43 which is closed at the bottom, and said container mouth 42 has the thread which can be screwed with said shrinking part 35 of said bedpan 30.

In this embodiment, a cleaning device 60, including: a front spout seat 61, arranged on said horizontal frames 14, and having a front spout 62 which is extended to the above of the front side of said seat 32 of said bedpan 30; a rear spout seat 63, arranged on said horizontal frames 14, and having a rear spout 64 which is extended to the above of the rear side of said seat 32 of said bedpan 30; in other words, said front spout seat 61 and said rear spout seat 63 are fixed on said horizontal frames 14, and will not affect the replacement and cleaning of said bedpan 30.

Referring to FIGS. 5A-6, a warm water supply device 70, including: a water storage bucket 71, arranged under the periphery of said bedpan 30, at the top of said water storage bucket 71 having a water inlet 72 and a cover 73, inside said water storage bucket 71 having an electric heater 74 and a pumping motor 75, said electric heater 74 uses an electric heat pipe 741 to heat up the water (W) to the predetermined temperature, said pumping motor 75 pumps the warmed water (W) from said water storage bucket 71, and sends it to said front spout seat 61 and said rear spout seat 63 through a front pipe 761 and a rear water pipe 762 of a delivery pipe 76, and then through said front spout 62 and said rear spout 64 to clean the patient's butt. In this embodiment, said warm water supply device 70 can be placed in a predetermined space below said bed frame 10, which is movable rather than fixed on said bed frame 10, and can be refilled with washing water (W) at any time by said water inlet 72; and can be placed at the lower periphery of said bedpan 30 which is better; and its main purpose is to provide the warm water required by said cleaning device 60, so that the patient can be more comfortable when washing the buttocks.

Figure 7:
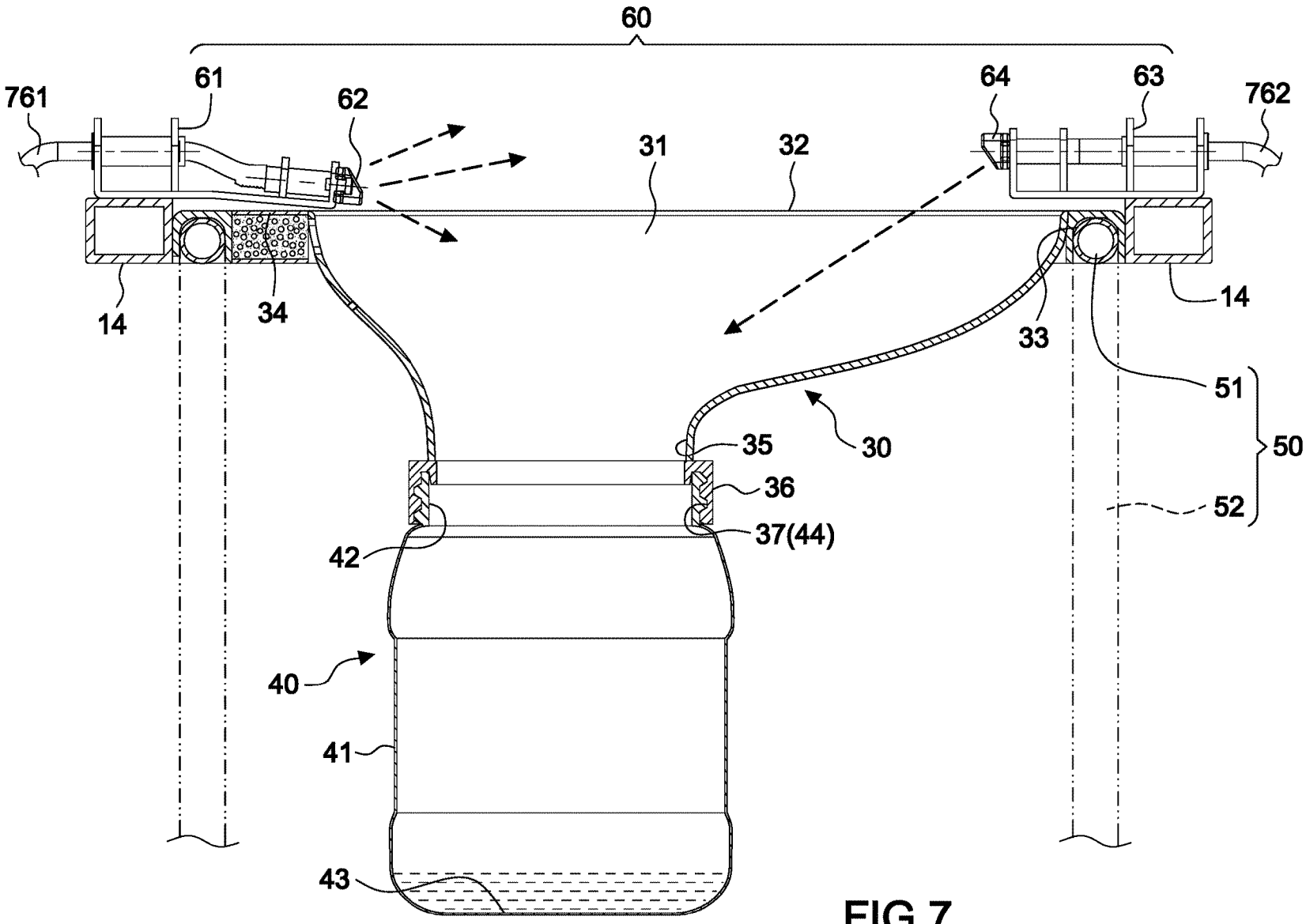
FIG. 7 is a sectional view of a support frame of the present invention.

Referring to FIG. 7, in this embodiment, said shrinking part 35 of said bedpan 30 has a screw part 36, the inner periphery is provided with female thread 37, and the container mouth 42 of said excreta container 40 is provided with male thread 44 which are screwed with female thread 37 for letting said excreta container 40 be screwed below said bedpan 30; Also, at least a contain slot 34 is provided on the surface of the seat 32 of said bedpan 30, and aromatic balls can be placed to drive off the odor of excrement.

Figure 8:
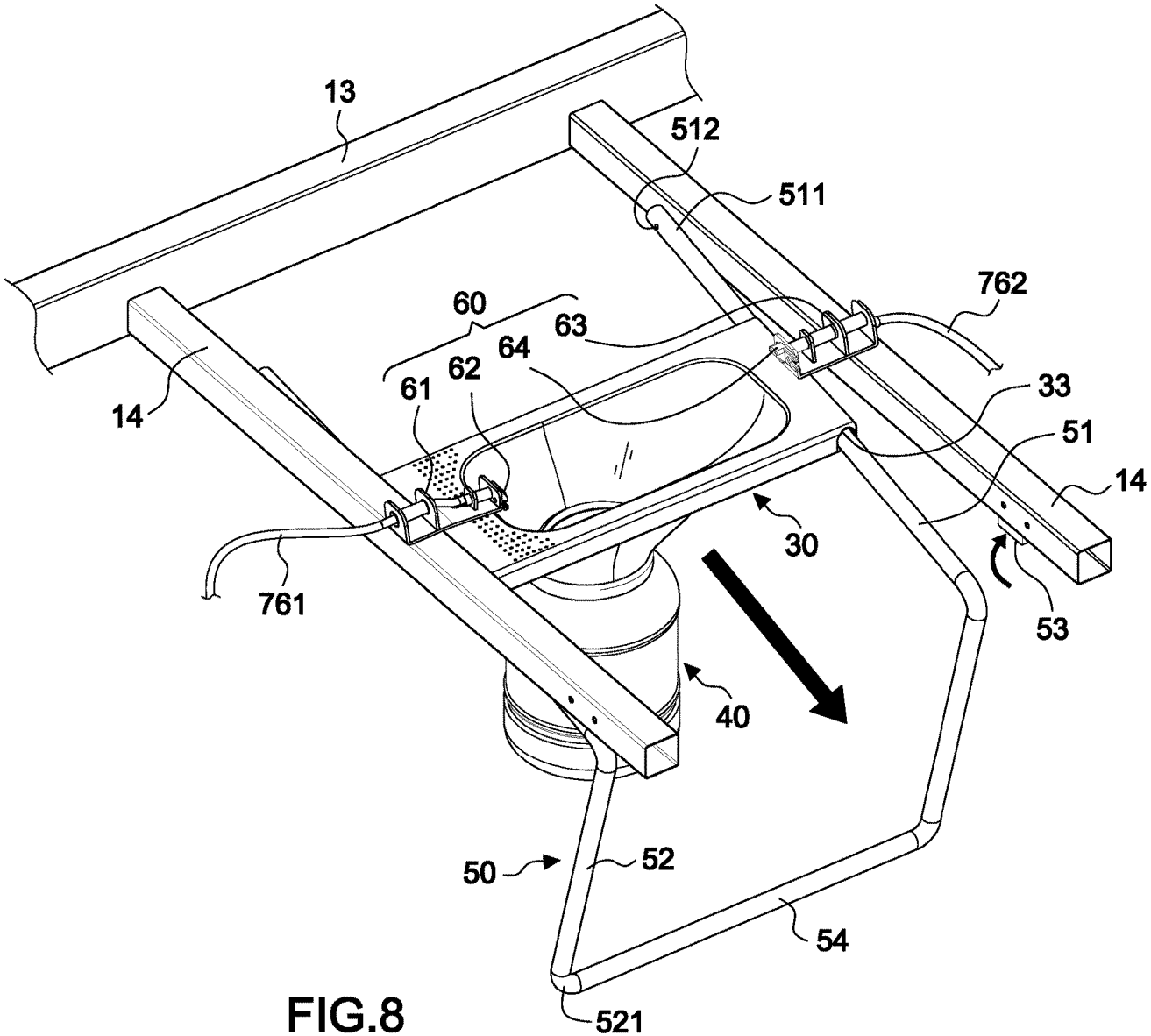
FIG. 8 is a schematic diagram illustrating the operating of the mechanism that is easy to disassemble of the present invention.
Figure 9:
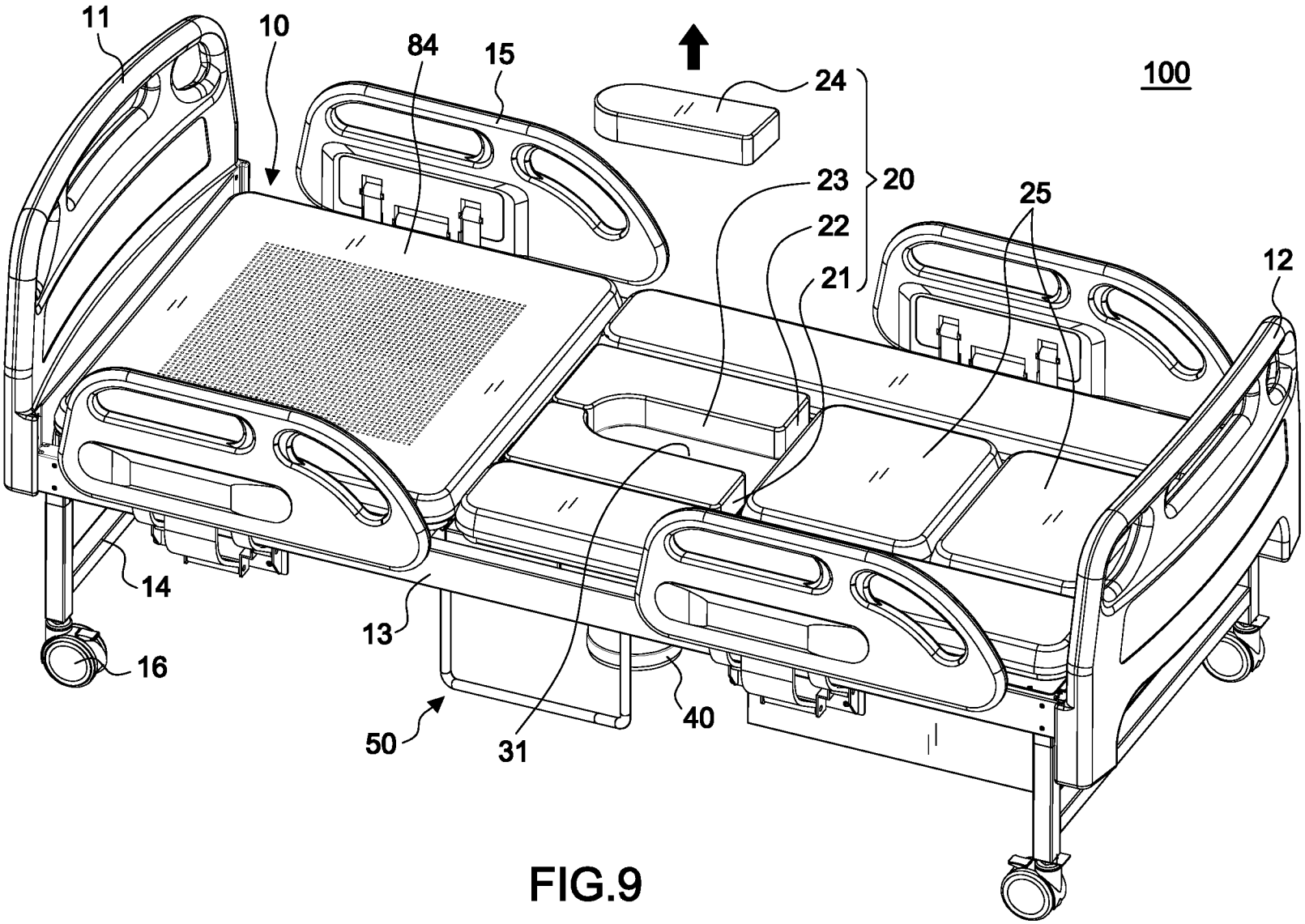
FIG. 9 is a schematic diagram illustrating the removal of the third cushion of the present invention.

Whereby, when the patient wants to defecate, as FIG. 9 showing, the patient only needs to remove said third cushion 24 and make said bedpan mouth 31 of said bedpan 30 facing said defecation hole 23, after the defecation, actuate hold paddles 53 to pivot said support frame 50 toward the ground and wait for the lower ends 521 of said support rod 52 until reaching the ground, as FIG. 8 showing, said support frame 50 further connected to a support rod 54, when said support frame 50 is pivoted toward the ground, said support rods 54 can stand on the ground to increase the rigidity of said support frame 50, and then move said seat 32 of said bedpan 30 to the outside of the support frame 50. Then said excreta container 40 can be easily rotated to be separated from said bedpan 30 to carry out excrement removal and cleaning operations.

Moreover, in the present invention, the lower edge of said bedpan 30 is connected with an excreta container 40, and said bedpan 30 is hung under said third cushion 24 through a support frame 50. When the patient wants to defecate, the patient only needs to remove said third cushion 24 and make said bedpan mouth 31 of said bedpan 30 facing said defecation hole 33, then the patient can defecate on the nursing bed; after the defecation, actuate said hold paddles 53 to pivot said support frame 50 toward the ground, and wait for said support rod 54 until reaching the ground, then move said seat 32 of said bedpan 30 to the outside of said support frame 50. Then said excreta container 40 can be easily rotated to be separated from said bedpan 30 to carry out excrement removal and cleaning operations.

Moreover, this present invention is further equipped with a cleaning device 60, including: a front spout 62 and a rear spout 64, and said front spout seat 61 and said rear spout seat 63 are arranged on said horizontal frames 14, so they will not affect the replacement and cleaning of said bedpan 30; and said warm water supply device 70 has an electric heater 74 to heat the cleaning water (W) to an appropriate temperature, then the pressure of the pumping motor 75 is sent to said front spout 62 and said rear spout seat 63 to clean the patient's buttocks, thereby reducing the infection of germs, and also cleaning the excrement that attached to the bedpan to keeps the bedpan clean.

Figure 10:
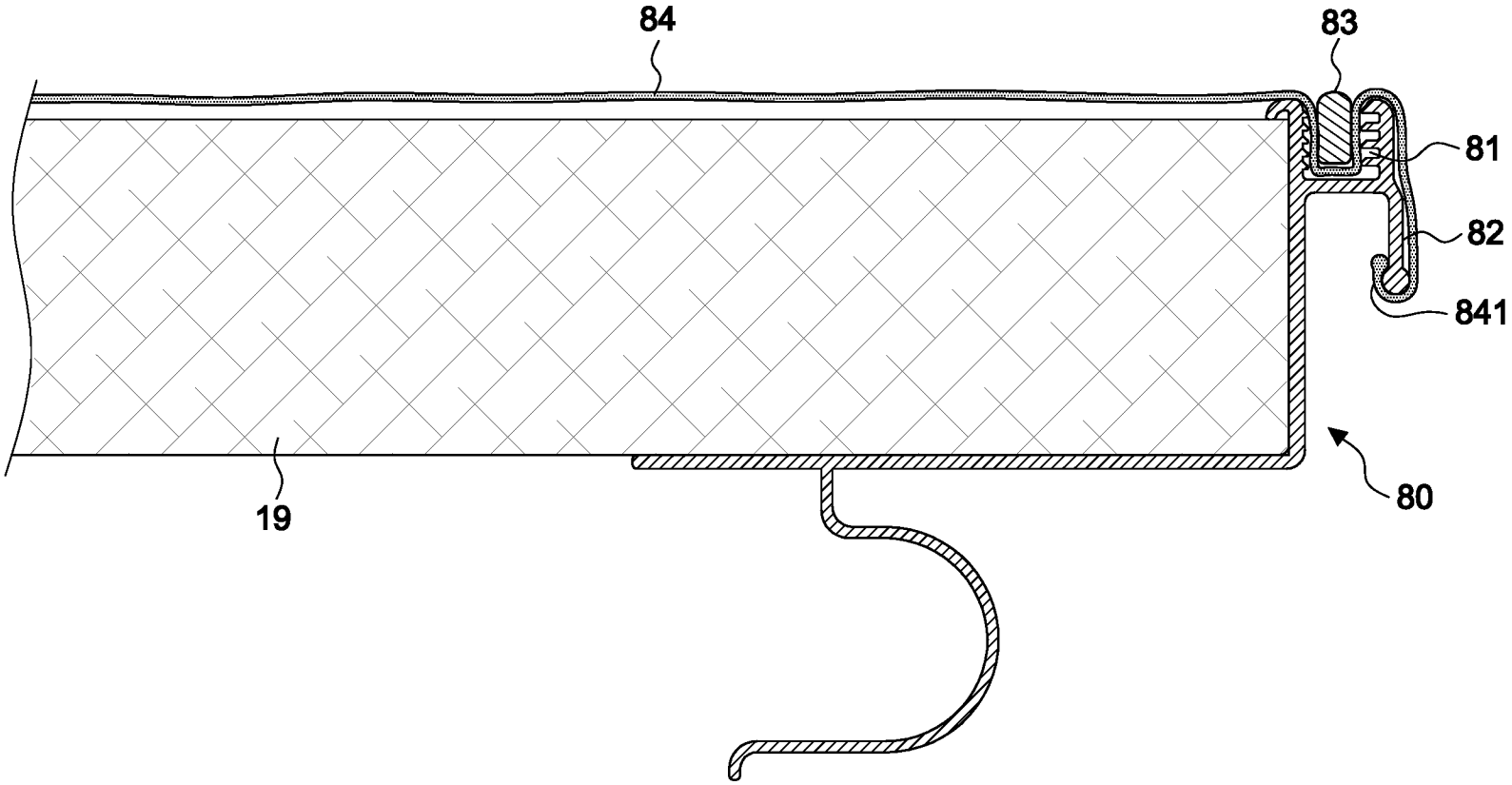
FIG. 10 is a sectional view of a part of the bed board device of the present invention.

Referring to FIG. 10, in this embodiment, the two sides of said bed frame 10 are provided with a frame 80 relative to said bed board device 19, for making said bed board device 19 easy to be fixed on said bed frame 10, the outer edge of said frame 80 is upwardly provided with a groove 81, and the outer side of said groove 81 is downwardly provided with an extension part 82, whereby a lock strip 83 can be used to embedded the two sides of a bed sheet 84 of said bed board device 19 in said groove 33 for positioning, and the two sides of the bed sheet can also be hooked on the extension body, making the bed sheet 84 stable in positioning.

Figure 11:
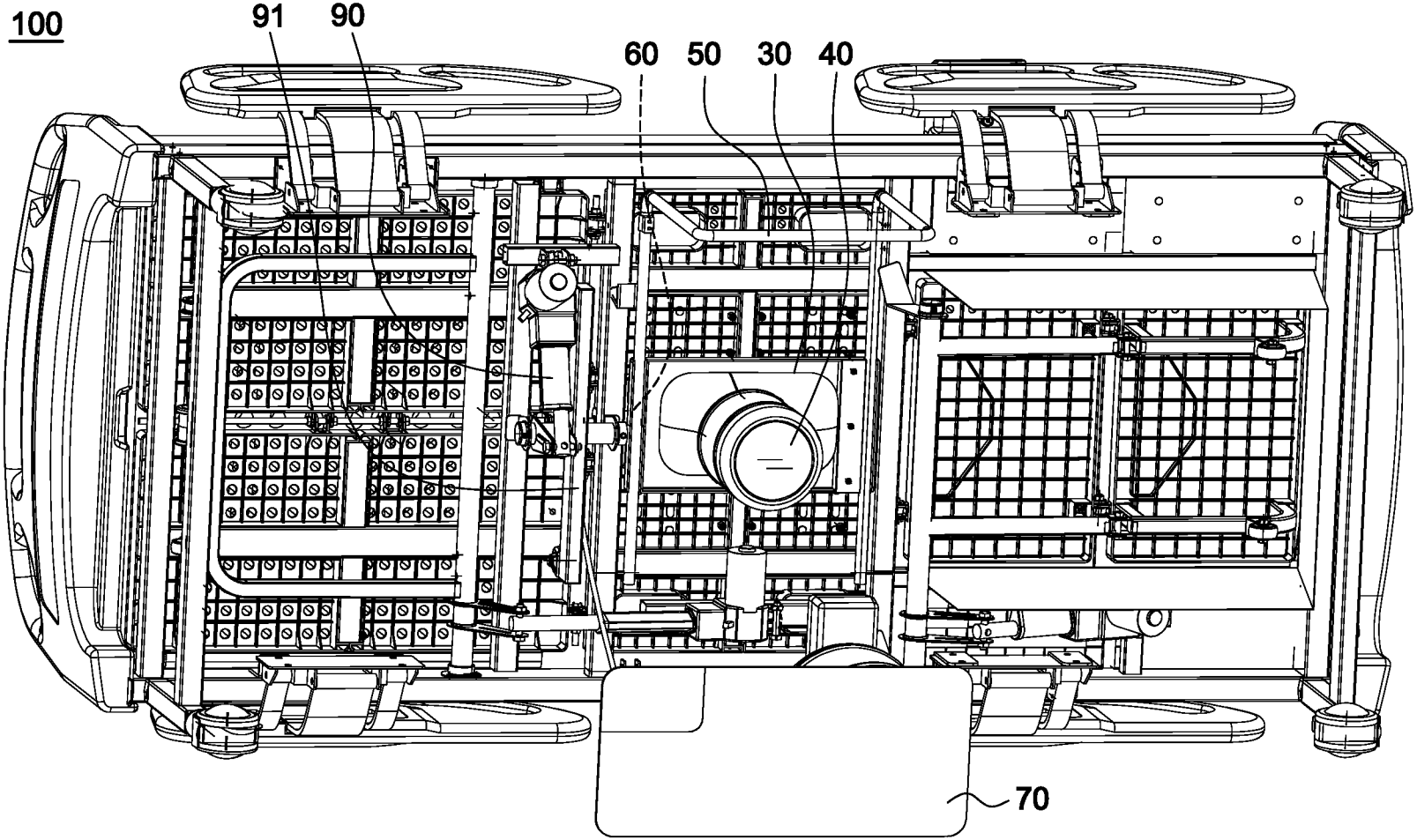
FIG. 11 is a schematic diagram illustrating the bottom of the bed of the present invention.

Referring to FIG. 11, which is a schematic diagram showing the bottom of said bed frame 10, which shows that even if said bedpan 30, excreta container 40, support frame 50, cleaning device 60 and warm water supply device 70 are installed in this invention, they still do not affect a motor 90 driving a patient turning device 91. The structure and actions of said patient turning device 91 have been disclosed in the inventor's previous patents, such as Taiwan Invention No. 1674889 and No. 1669109; because said patient turning device 91 is not the subject of the present invention, I will not go into details here. Therefore, compared with the previous patent, the present invention further allows that patients can wash their buttocks with warm water on the nursing bed, which is more convenient and user-friendly.

What is claimed is:

1. A nursing bed for defecation and self-cleaning, comprising:

a bed frame, forming by a front frame, a rear frame, and multiple longitudinal frames and horizontal frames linked between said front frame and said rear frame;

a bed board device, arranged on said bed frame and arranged between said front frame and said rear frame;

a moveable cushion which can be separated from said bed board device, arranged on said bed frame and arranged between said front frame and said rear frame; said moveable cushion at least includes a first cushion and a second cushion, between said first cushion and said second cushion have a defecation hole, and a third cushion which can be easily removed is arranged on said defecation hole;

a support frame, having a pair of horizontal rods and a pair of stand rods symmetrically arranged and vertically connected, wherein free ends of each said horizontal rods are individually pivotally connected to an inner side of said horizontal frames, and at least a hold paddle is pivoted on said horizontal frames and hung on an lower edge of said horizontal rods for letting said support frame hang on said bed frame and keeping lower ends of said stand rods away from a ground;

a bedpan, having a bedpan mouth at a top and having a seat with a groove at an outer periphery of said bedpan mouth, and said bedpan is hung at the outer periphery of said horizontal rods; said seat is shrinking downward to form a shrinking part at a second lower end, and said shrinking part is designed with thread;

an excreta container, arranged under said bedpan, having a container mouth at a top of said container body and having a bottom surface which is closed at the bottom, and said container mouth has the thread which can be screwed with said shrinking part;

a cleaning device, including: a front spout seat, arranged on said horizontal frames, and having a front spout which is extended above the front side of said seat of said bedpan; a rear spout seat, arranged on said horizontal frames, and having a rear spout which is extended above the rear side of said seat of said bedpan;

a warm water supply device, including: a water storage bucket, arranged under the periphery of said bedpan, at the top of said water storage bucket having a water inlet and a cover, inside said water storage bucket having an electric heater and a pumping motor, said electric heater uses an electric heat pipe to heat up the water to a predetermined temperature, said pumping motor pumps the warmed water from said water storage bucket, and sends it to said front spout seat and said rear spout seat through a front pipe and a rear water pipe of a delivery pipe, and then through said front spout and said rear spout to clean a patient's butt.

2. The nursing bed for defecation and self-cleaning as claimed in claim 1, wherein said support frame has a support rod which connected to the bottom ends of said pair of stand rods, when said support frame is pivoted toward the ground, said support rods can stand on the ground to increase the rigidity of said support frame, thereby improving the stability of the excreta container during disassembling.

3. The nursing bed for defecation and self-cleaning as claimed in claim 1, wherein said shrinking part of said bedpan has a screw part, the inner periphery is provided with female thread, and said container mouth of said excreta container is provided with male thread which are screwed with female thread.

4. The nursing bed for defecation and self-cleaning as claimed in claim 1, wherein at least a contain slot is provided on the surface of said seat of said bedpan, and aromatic balls can be placed to drive off an odor of excrement.

5. The nursing bed for defecation and self-cleaning as claimed in claim 1, wherein said front frame and said rear frame having at least a latch, and said longitudinal frame has a latch slot corresponding to said latch, so as to make said front frame and said rear frame be easy to disassemble and assemble.

6. The nursing bed for defecation and self-cleaning as claimed in claim 1, wherein the two sides of said bed frame are provided with a frame relative to said bed board device, the outer edge of said frame is upwardly provided with a groove, and the outer side of said groove is downwardly provided with an extension part, whereby a lock strip can be used to embedded the two sides of a bed sheet of said bed board device into said groove for positioning, and the two sides of the bed sheet can also be hooked on the extension part.

* * * * *